US005924664A

United States Patent [19]

Mileos et al.

[11] Patent Number: 5,924,664

[45] Date of Patent: Jul. 20, 1999

[54] KEYBOARD SUPPORT MECHANISM

[75] Inventors: George Mileos, Riverdale; Robert King, New York, both of N.Y.

[73] Assignee: Ergo View Technologies Corp., New York, N.Y.

[21] Appl. No.: 08/995,889

[22] Filed: Dec. 22, 1997

Related U.S. Application Data

[60] Provisional application No. 60/040,972, Mar. 12, 1997.

[51] Int. Cl.[6] ..... A47F 5/00

[52] U.S. Cl. ..... 248/281.11; 108/138; 108/145; 248/284.1

[58] Field of Search ..... 248/281.11, 284.1, 248/918, 291.1, 292.12; 108/139, 140, 141, 143, 145, 138

[56] References Cited

U.S. PATENT DOCUMENTS

| | | | |
|---|---|---|---|
| D. 339,703 | 9/1993 | Pangborn et al. . | |
| 696,545 | 4/1902 | Browne | 248/281.1 X |
| 3,041,034 | 6/1962 | Wilkinson | 248/284.1 |
| 4,316,082 | 2/1982 | Fritz . | |
| 4,379,429 | 4/1983 | Gubbe et al. . | |
| 4,421,035 | 12/1983 | Gubbe et al. . | |
| 4,496,200 | 1/1985 | Hagstrom et al. . | |
| 4,616,798 | 10/1986 | Smeenge et al. . | |
| 4,625,657 | 12/1986 | Little et al. . | |
| 4,632,349 | 12/1986 | Anstey . | |
| 4,644,875 | 2/1987 | Cotterill . | |
| 4,691,888 | 9/1987 | Watt . | |
| 4,706,919 | 11/1987 | Soberalski et al. . | |
| 4,776,284 | 10/1988 | McIntosh . | |
| 5,031,867 | 7/1991 | Cotterill . | |
| 5,037,054 | 8/1991 | McConnell . | |
| 5,040,760 | 8/1991 | Singer . | |
| 5,041,770 | 8/1991 | Seiler et al. . | |
| 5,145,136 | 9/1992 | McConnell . | |
| 5,211,367 | 5/1993 | Musculus . | |
| 5,219,136 | 6/1993 | Hassel et al. . | |
| 5,257,767 | 11/1993 | McConnell . | |
| 5,273,250 | 12/1993 | Pemberton et al. . | |
| 5,292,097 | 3/1994 | Russell . | |
| 5,294,087 | 3/1994 | Drabczyk et al. . | |
| 5,302,015 | 4/1994 | Du Vall . | |
| 5,351,897 | 10/1994 | Martin . | |
| 5,377,951 | 1/1995 | Johnson et al. . | |
| 5,443,237 | 8/1995 | Stadtmauser . | |
| 5,487,525 | 1/1996 | Drabczyk et al. . | |
| 5,490,466 | 2/1996 | Diffrient . | |
| 5,523,331 | 6/1996 | Lechman et al. . | |
| 5,526,180 | 6/1996 | Rausnitz . | |
| 5,549,052 | 8/1996 | Hoffman . | |
| 5,582,375 | 12/1996 | Martin . | |
| 5,707,034 | 1/1998 | Cotterill | 248/284.1 |

*Primary Examiner*—Derek J. Berger
*Attorney, Agent, or Firm*—Bryan Cave LLP

[57] ABSTRACT

A keyboard support mechanism containing a novel articulating arm mechanism for permitting vertical movement of the keyboard shelf. The articulating arm mechanism has six major components: (1) a mounting bracket, (2) a mounting bracket support in combination with a swivel bracket, (3) a shelf bracket, (4) an upper arm, (5) at least one side arm, and (6) at least one stopping means. The upper arm links the shelf bracket and the mounting bracket; the side arm and the stopping means cooperate to keep the shelf bracket (and hence the keyboard shelf) at a constant angle relative to the ground.

14 Claims, 12 Drawing Sheets

KEYBOARD SUPPORT MECHANISM

CROSS-REFERENCE TO RELATED APPLICATIONS

This application is a continuation-in-part of Provisional U.S. Application Ser. No. 60/040,972, filed Mar. 12, 1997 in the name of the same inventors and bearing the same title.

FIELD OF THE INVENTION

This invention relates to improved adjustable support mechanisms for keyboards and other items.

BACKGROUND OF THE INVENTION

The use of computers for both personal and business use has become so common that it is fair to say that almost all businesses, and many homes, have at least one computer or computer terminal. Computers are particularly prevalent in the office environment. Among the health issues which have become increasingly important as the use of computers has become more common is the need to promote proper posture while using the computer so as to both maintain working efficiency and minimize the occurrence of repetitive stress injuries. One basic principal which has been developed to address these issues is that the computer keyboard should be used while at a level considerably below the level of most desktops, so the user's wrists, when the keyboard is in use, are a "neutral" position; that is, the surface defined by the user's forearms and the top of his or her hands is flat. In addition to regulating the height at which the keyboard is used, it is also important for ergonomic purposes to control the angle which the keyboard shelf makes with the ground.

There have been a number of devices which have been developed for use in supporting keyboards (and associated computer accessories, such as a computer mouse) at a level below the surface of a desk while in use and underneath the desk when not in use. One such device is described in Smeenge, et al., U.S. Pat. No. 4,616,798, which discloses the use of a parallelogram linkage to connect a shelf for holding a keyboard to the underside of the desk surface. The overall system described by Smeenge permits a fair degree of flexibility in positioning the keyboard relative to the user and the desk. One disadvantage of Smeenge's system is that the parallelogram linkage used by the system is attached to the underside of the keyboard support shelf. Therefore, when the keyboard is positioned underneath the desk, the leg room available to the user between the bottom of the mechanism and the floor is limited.

McConnell, U.S. Pat. No. 5,257,767 attempted to address this deficiency of the Smeenge mechanism by using a non-parallelogram linkage to connect the keyboard shelf to the underside of the desk. This non-parallelogram linkage causes the front of the keyboard shelf to be angled upwards when the shelf is lowered relative to the desk top, marginally increasing the leg room available to the user when the keyboard is positioned beneath the desk. Like the Smeenge mechanism, the McConnell mechanism has its linkage attached to the bottom of the keyboard shelf, which limits the total leg room available to the user.

SUMMARY OF THE INVENTION

In one aspect, this invention improves upon the prior art mechanisms by the use of a novel linkage between the underside of the desk and the keyboard shelf, which novel linkage increases the leg room available to the user. The improved mechanism of this invention permits the adjustment of the angle of the keyboard shelf relative to the ground within certain parameters so that the angle is ergonomically correct for the vast majority of users.

The mechanism according to this aspect of the invention comprises a novel articulating arm mechanism for permitting vertical movement of the keyboard shelf The articulating arm mechanism has six major components: (1) a mounting bracket, (2) a mounting bracket support in combination with a swivel bracket, (3) a shelf bracket, (4) an upper arm, (5) at least one side arm, and (6) at least one stopping means. The upper arm links the shelf bracket and the mounting bracket; the side arm and the stopping means cooperate to keep the shelf bracket at a constant angle relative to the ground.

A second aspect of the invention comprises the attachment of a linkage between a desk and a keyboard shelf so that nothing extends beneath the bottom of the keyboard shelf.

DETAILED DESCRIPTION

As used in this specification and the appended claims, the term "desk" means any desk, table, shelf, or other suitable work surface. The term "desk top" means the working surface of a desk (i.e. the surface facing upwards). The term "front" when applied to any component of the auxiliary shelf mechanism means the end closest to the user; the term "back" means the part farthest away from the user.

Figure 1:
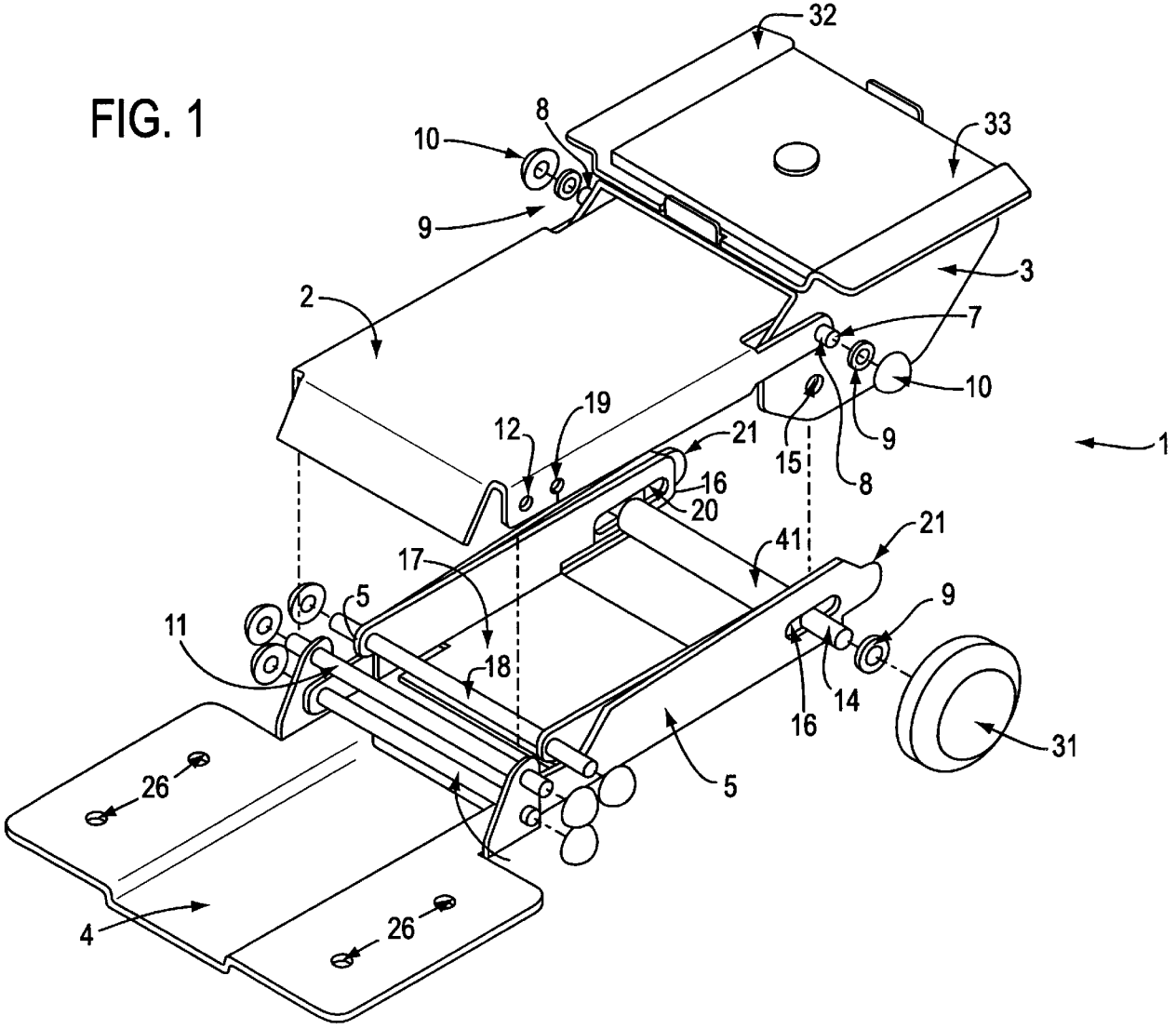
FIG. 1 is an exploded, perspective view of the auxiliary shelf mechanism of the invention.

Referring to FIG. 1, there is illustrated an exploded view of an auxiliary shelf mechanism 1 according to the invention. Auxiliary shelf mechanism 1 includes an upper arm 2, a mounting bracket 3, a shelf bracket 4, and a pair of side arms 5. Though two side arms 5 are shown in FIG. 1 and constitute the preferred embodiment, only one side arm is required. Attached to mounting bracket 3 is a mounting bracket support 6 (shown in FIG. 6) in combination with swivel bracket 32 and swivel bracket support 33. The combination of the swivel bracket 33 and the mounting bracket support is illustrated in further detail in FIG. 6. A first pivot rod 7 connects mounting bracket 3 to upper arm 2 at paired pivot points 8, secured by washers 9 and push nuts 10. Upper arm 2 is attached to shelf bracket 4 by means of second pivot rod 11 through holes 12 (one such hole is not shown).

Side arms 5 are attached to shelf bracket 4 by means of third pivot rod 13. The use of two side arms 5 is preferred and illustrated because this arrangement enhances stability of shelf bracket 4, but only one is necessary. Side arms 5 are attached to mounting bracket 3 by means of bolt 14, which extends through holes 15 in the mounting bracket 3 (one not shown) and through first openings 16 in the side arms. Spacer 41 is wrapped around bolt 14 and is wider than first openings 16, so as to prevent it from sliding out from between side arms 5 via first openings 16. Spacer 41 provides assistance in locking the mechanism in place, as described more fully below. One end of bolt 14 is square (this end is not shown in drawing). The square end can either be part of bolt 14 as manufactured or can be a cover which is slipped onto the round end. The square end prevents bolt 14 from rotating due to the interaction of the square end with first opening 16.

Preferably, the distance between hole 15 in the mounting bracket 3 and pivot point 8 is greater than the distance between where third pivot rod 13 contacts shelf bracket 4 and hole 12 in shelf bracket 4. Alternatively, the distance between hole 15 in the mounting bracket 3 and pivot points 8 is can be less than the distance between where third pivot rod 13 contacts shelf bracket 4 and hole 12 in shelf bracket 4.

A curved end 21 of each side arm 5 projects behind first openings 16 away from shelf bracket 4. Lower arm 17 is not required, but is included in the preferred embodiments shown in the drawings. Lower arm 17 is attached to upper arm 2 by means of fourth pivot rod 18 through holes 19 (one not shown) in upper arm 2. Lower arm 17 is also attached to both side arms 5 and mounting bracket 3 by means of bolt 14. Bolt 14 passes through lower arm 17 through second openings 20 (one not shown).

Figure 2:
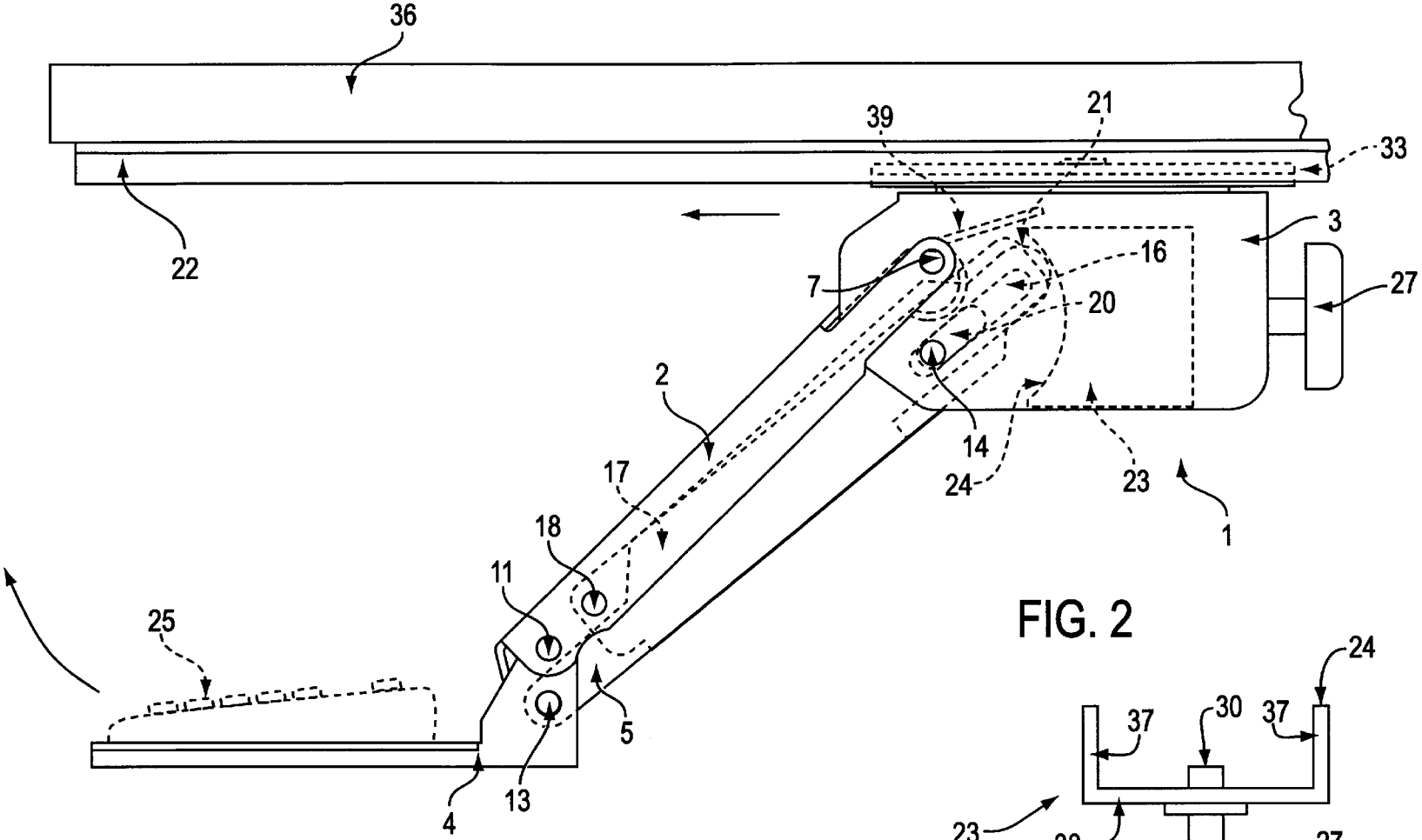
FIG. 2 is a side elevational view of the auxiliary shelf mechanism in its downward and retracted position. Those parts of the mechanism which would not ordinarily be seen from this angle are shown in dotted lines; a keyboard is also shown in dotted lines, but does not form part of the invention.

As shown in FIG. 2, auxiliary shelf mechanism 1 may be attached to the underside of a desk top 36 by means of mounting track 22. Mounting track 22 is affixed to the underside of desk top 36 by conventional means, such as nails or screws. Swivel bracket support 33 cooperates with mounting track 22 as is more fully shown in FIG. 6 to permit auxiliary shelf mechanism 1 to slide back and forth relative to mounting track 22. Also shown in FIG. 2 is stopping means 23, which is attached to mounting bracket 3. Stopping means 23 has a first side 24 which faces towards the curved end 21 of the side arm. There is one first side 24 for each side arm 5. Preferably, though not necessarily, first side 24 is concave in shape, as shown in the different figures.

Figure 3:
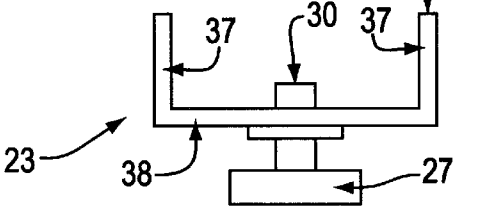
FIG. 3 is a top plan view of an adjustable stopping means for use in the auxiliary shelf mechanism of the invention.

In an embodiment where the stopping means is adjustable and when two side arms are used, the two first sides 24 can form part of a single stopping means, which consequently has a C-shaped top profile, as shown in FIG. 3 (the first sides 24 representing the ends of the short parts of the "C" 37), with the open side of the "C" facing towards the front. The center piece 38 connecting the two sides of the stopping means 23 can have its lateral position relative to mounting bracket 3 adjusted by means of knob 27, as described more fully below, or by any other means. When two side arms 5 are used, but stopping means 23 is not adjustable, two stopping means may be used, each of which may be attached in a fixed manner by spot-welding or flat riveting (or other conventional means) to the side of mounting bracket 3.

Keyboard 25 (not part of this invention) can rest directly on shelf bracket 4, as shown in the drawing. Preferably, however, an additional, wider keyboard shelf (not shown) is attached to shelf bracket 4 through attachment holes 26 (as shown in FIG. 1), on which can rest the keyboard. Additional components, such as a supplemental shelf for a computer mouse or pad of paper may be attached to the keyboard shelf (or directly to shelf bracket 4).

In the preferred embodiment, upper arm 2, lower arm 17, and mounting bracket 3 thereby form a wedge-shaped box whose surfaces are made up of the top of upper arm 2, the base of lower arm 17, and the overlapping sides of upper arm 2 and lower arms 17, and whose edges are defined by first pivot rod 7, fourth pivot rod 18, and bolt 14. From the side, as shown in FIG. 2, the system resembles a triangle, which can be pivoted to permit the raising or lowering of shelf bracket 4 relative to mounting bracket 3, and hence the top of the desk 36. As upper arm 2 pivots about first pivot rod 7, lower arm 17 both pivots about bolt 14 and slides forward or backward relative to it, via first and second openings 16 and 20.

Curved ends 21 of side arms 5 contact first sides 24 of stopping means 23. This prevents side arms 5 from sliding rearwards, relative to bolt 14, past the point where side arms 5 contact the first sides 24 of the stopping means 23. When first sides 24 have a concave shape, this point varies as side arms 5 are pivoted around bolt 14. By positioning stopping means 23 at a specific distance behind bolt 14, and giving first sides 24 of stopping means 23 a particular degree of curvature (which may be easily determined by one of ordinary skill in the art), shelf bracket 4 can be kept at consistent angle relative to the ground, regardless of the height of shelf bracket 4 relative to mounting bracket 3.

Side arms 5 are kept in contact with the first sides 23 of stopping means 24 by means of the arrangement of shelf bracket 4, upper arm 2, and side arms 5. Upper arm 2 is pivotally connected to shelf bracket 4 by means of second pivot rod 11. Therefore, the weight of shelf bracket 4 (plus the weight of anything else attached to it or resting on it) will tend to force shelf bracket 4 to pivot around first pivot rod 11. This pivoting action forces third pivot rod 13 backwards, in turn forcing side arm 5 (attached to shelf bracket 4 by means of third pivot rod 13) back into the first sides 24 of stopping means 23. Thus, side arms 5 will always be in contact with stopping means 23, keeping shelf bracket 4 at a consistent horizontal orientation.

Figure 4:
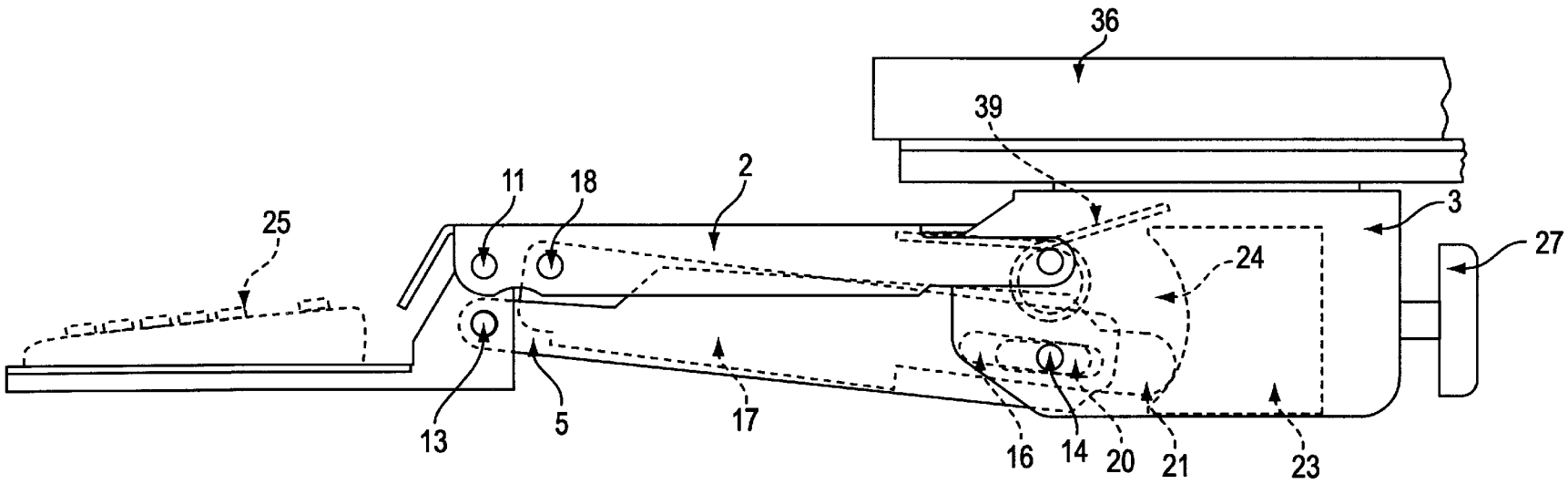
FIG. 4 is a side elevational view, similar to the view in FIG. 2, showing the auxiliary shelf mechanism in an extended and upward position.
Figure 5:
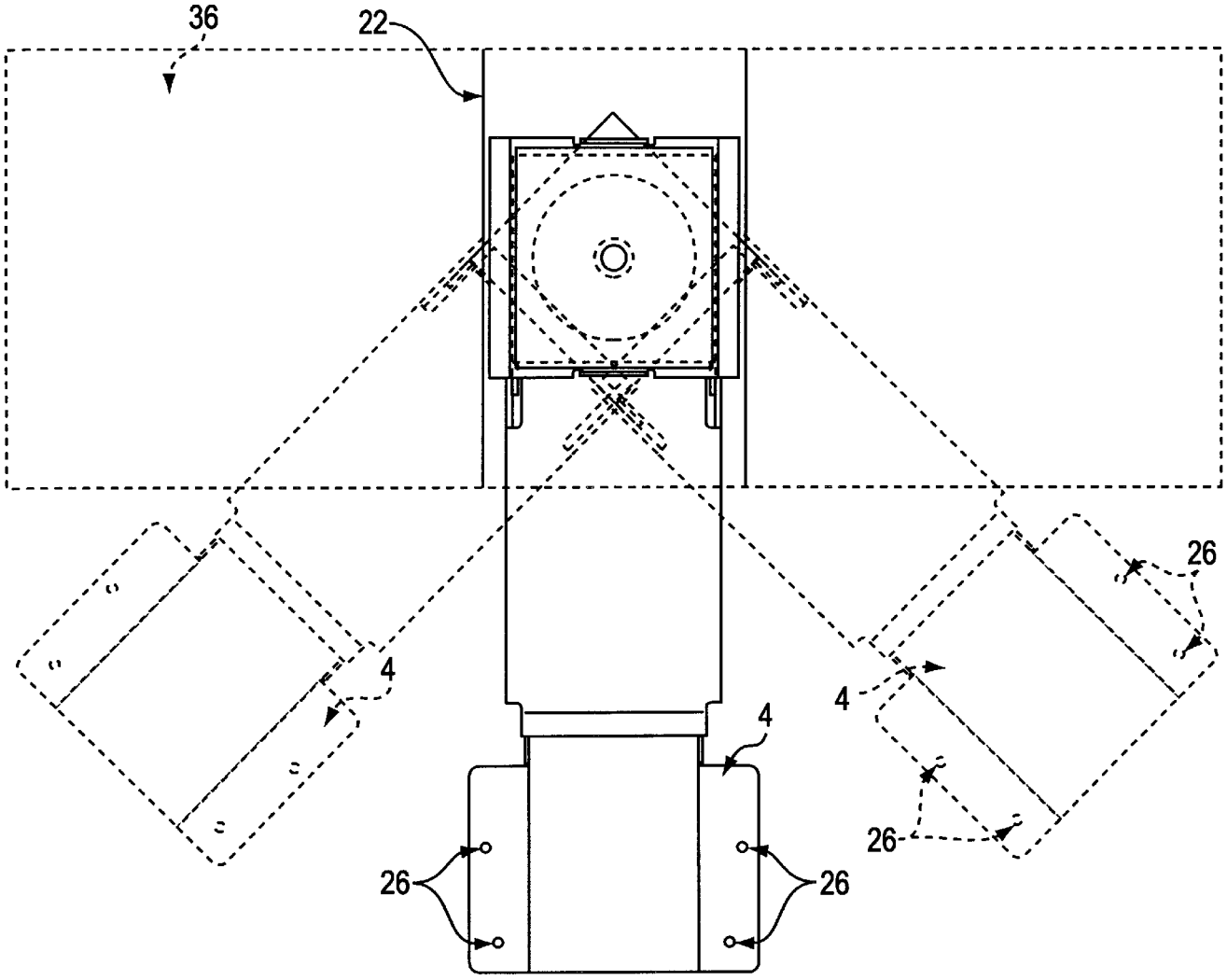
FIG. 5 is a top plan view showing the auxiliary shelf mechanism as attached to a desk. The dotted lines show how the auxiliary shelf mechanism may be rotated relative to the desk, which is also shown in dotted lines.

The relative movements of the various components of the mechanism as shelf bracket 4 is moved in a vertical direction can best be appreciated by comparing their positions as shown in FIGS. 2 and 4, which depict auxiliary shelf mechanism 1 in a retracted, downward position and in an extended, forward position respectively.

It is preferable to upwardly bias auxiliary shelf mechanism 1 slightly, by means of a torsion spring 39, or other types of springs (eg. leaf springs) or other conventional mechanisms, such as a compressible fluid cylinder.

Stopping means 23 can be fixed in position during the manufacturing process by any conventional means. Among the means for fixing it are spot welding or flat riveting. Fixing the stopping means in position ensures that the horizontal orientation of shelf bracket 4 remains constant.

Alternatively, the position of stopping means 23 can be adjustable. By adjusting the position of the stopping means, the angle of shelf bracket 4 relative to the ground can be changed. This is because a change in position of stopping means 23 changes the amount by which the side arms 5 can be pushed back, which in turn changes the angle of shelf bracket 4 to the ground. Preferably the position of stopping means 23 can only be adjusted within certain parameters, the limits of which ensure that the angle of shelf bracket 4 is always within an ergonomically acceptable range.

Figure 7:
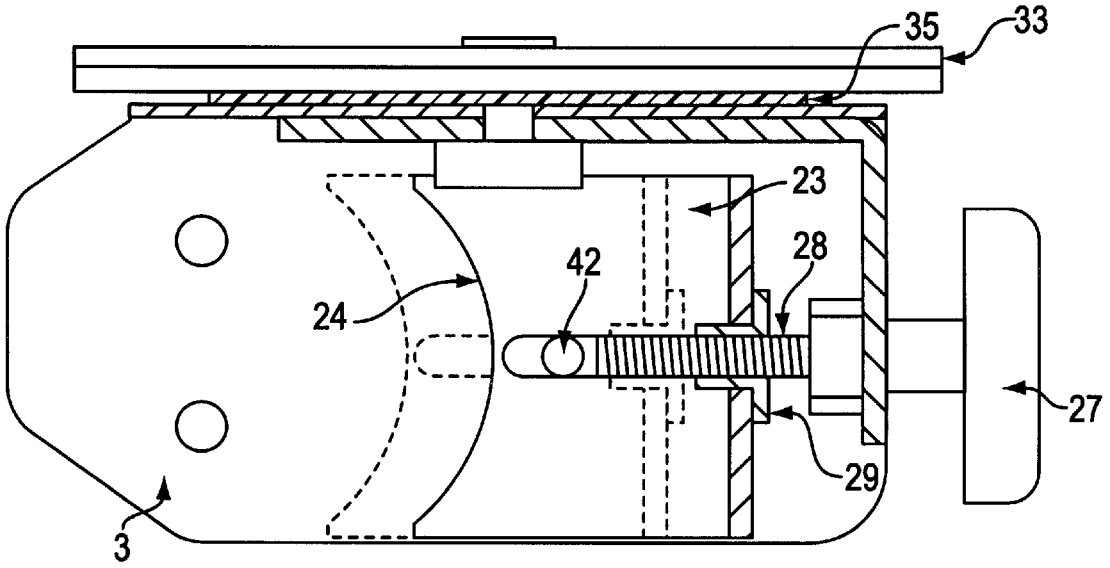
FIG. 7 is a side elevational view of a portion of a different embodiment of the invention, showing a movable stopping means. The dotted lines show the stopping means in a different position.
Figure 9:
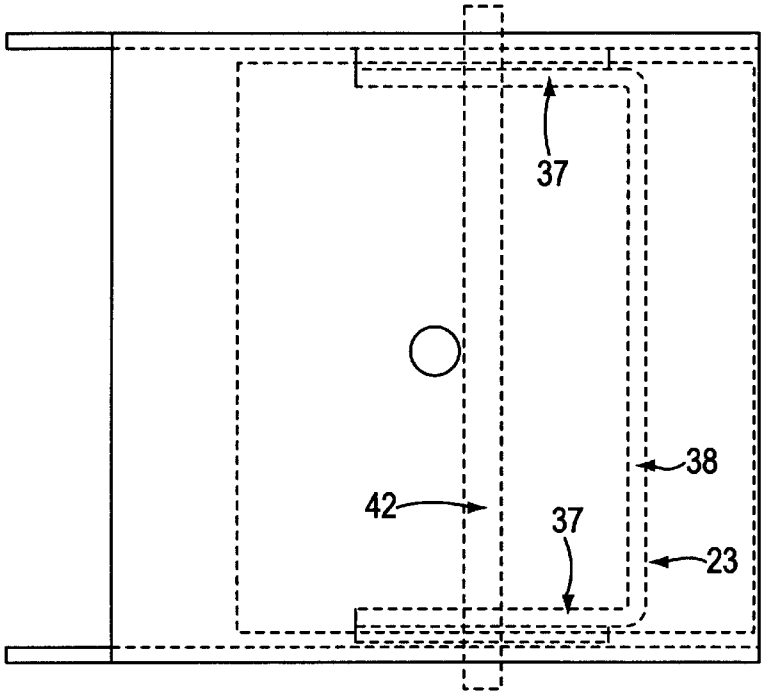
FIG. 9 is a top view of an embodiment of the invention, showing a movable stopping means.
Figure 8:
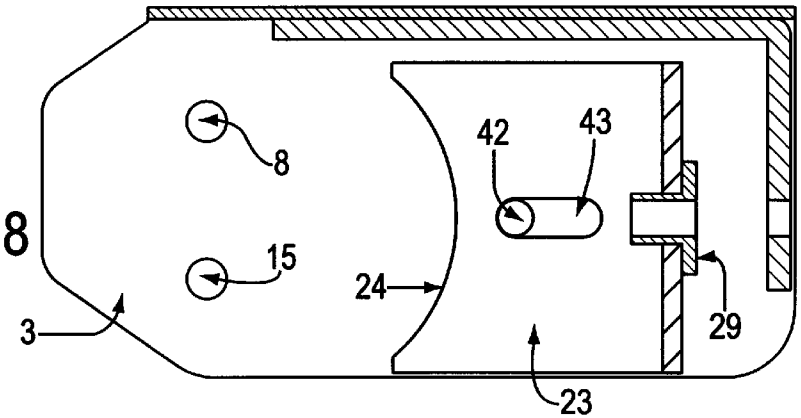
FIG. 8 is a side elevational view of the portion of the invention shown in FIG. 7, showing slightly different details of the movable stopping means.

If stopping means 23 is movable, its position may be adjusted by a variety of means, such as with a sliding track with a locking mechanism, or with a rack and pinion mechanism, or with a pneumatic cylinder. One preferred means, however, is by way of a screw-type mechanism, as shown in FIGS. 7–9. Knob 27 is connected by threaded bolt 28 to stopping means 23. Threaded bolt 28 is attached to stopping means 23 by being screwed into threaded aperture 29 in stopping means 23. As knob 27 is turned in one direction, threaded bolt 28 is also turned; because stopping means 23 and threaded aperture 29 cannot also turn (because of geometric constraints within mounting bracket 3), the turning of threaded bolt 28 in one direction forces it to unscrew from threaded aperture 29, pushing stopping means 23 towards the front of mounting bracket 3. The turning of knob 27 in the other direction has the opposite effect. The degree to which threaded bolt 28 can be screwed or unscrewed from the threaded aperture 29 (and hence the degree to which stopping means 23 may be moved) may be governed by the use of mechanical stopping means as shown in FIGS. 8 and 9. FIG. 9 shows a top view of the mechanism. As may be seen from the drawing, stop rod 42 runs parallel to center piece 38 of stopping means 23. FIG. 8 shows a side view of mounting bracket 3 with stopping means 23. Stop rod 42 is fixed in place and is vertically positioned in the middle of ends 37 of stopping means 23, running through ends 37 via third openings 43 (only one shown). As stopping means 23 moves back and forth relative to mounting bracket 3 from the turning of knob 27, third openings 43 move relative to stop rod 42. Once stop rod 42 reaches an end of third openings 43, stopping means 23 cannot move any further in that direction. The dotted lines in FIG. 7 show stopping means 23 in a forwardly displaced position compared to the position shown in the solid lines.

Other simple mechanical means may also be used to limit the amount by which stopping means 23 can be moved.

Figure 13:
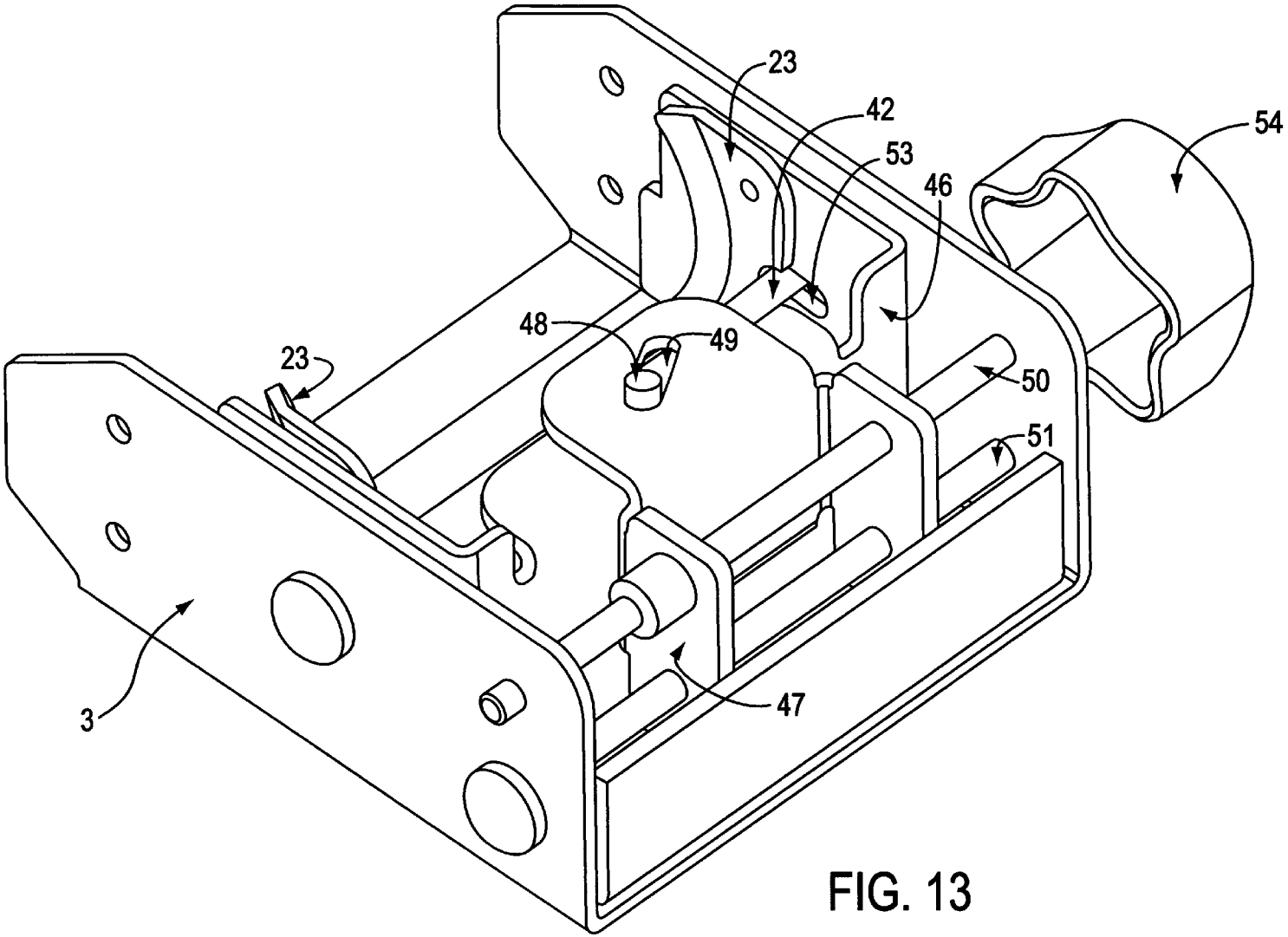
FIG. 13 is a bottom elevational view of a different movable stopping means.

Another screw-type mechanism for adjusting the position of the stopping means is shown in FIGS. 13–16. As shown in FIG. 13, sliding bracket 46 is adjacent to mounting bracket 3. Sliding bracket 46 is shown in more detail in FIG. 15. Stopping means 23 are attached to sliding bracket 46 by conventional means, such as rivets or screws. Sliding bracket 46 has, near to where stopping means 23 are attached to it, fourth openings 53, through which passes stop rod 42, which is attached to mounting bracket 3. As was discussed above in connection with FIGS. 7 and 8, the interaction between stop rod 42 and fourth openings 53 limits the amount of possible back and forth movement by the mechanism.

Figure 15:
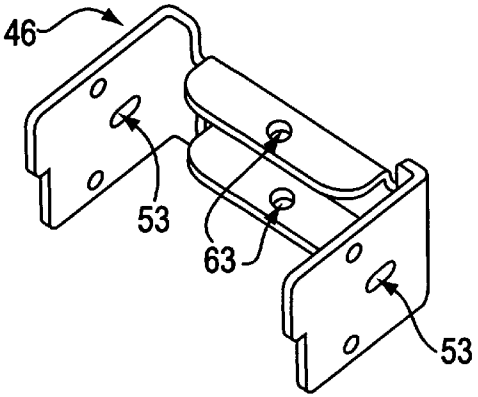
FIG. 15 is a top elevational view of element of the mechanism used to allow the stopping means to move as shown in FIG. 13.

Sliding bracket 46 is attached to setting bracket 47 (shown in more detail in FIG. 16) by means of attachment pin 48 which passes through opening 49 in setting bracket 47 and openings 63 in sliding bracket 46 (shown in FIG. 15). Setting bracket 49 is attached to mounting bracket 3 by means of attachment rods 50 and 51, which pass through holes 52 (see FIG. 16). Opening 49 is angled so that as setting bracket 47 is moved from side to side relative to mounting bracket 3, attachment pin 48, which must slide within the confines of opening 49 is forced to move either forward or backward, which in turn forces sliding bracket 46 and stopping means 23 to also move forward or backward.

Figure 14:
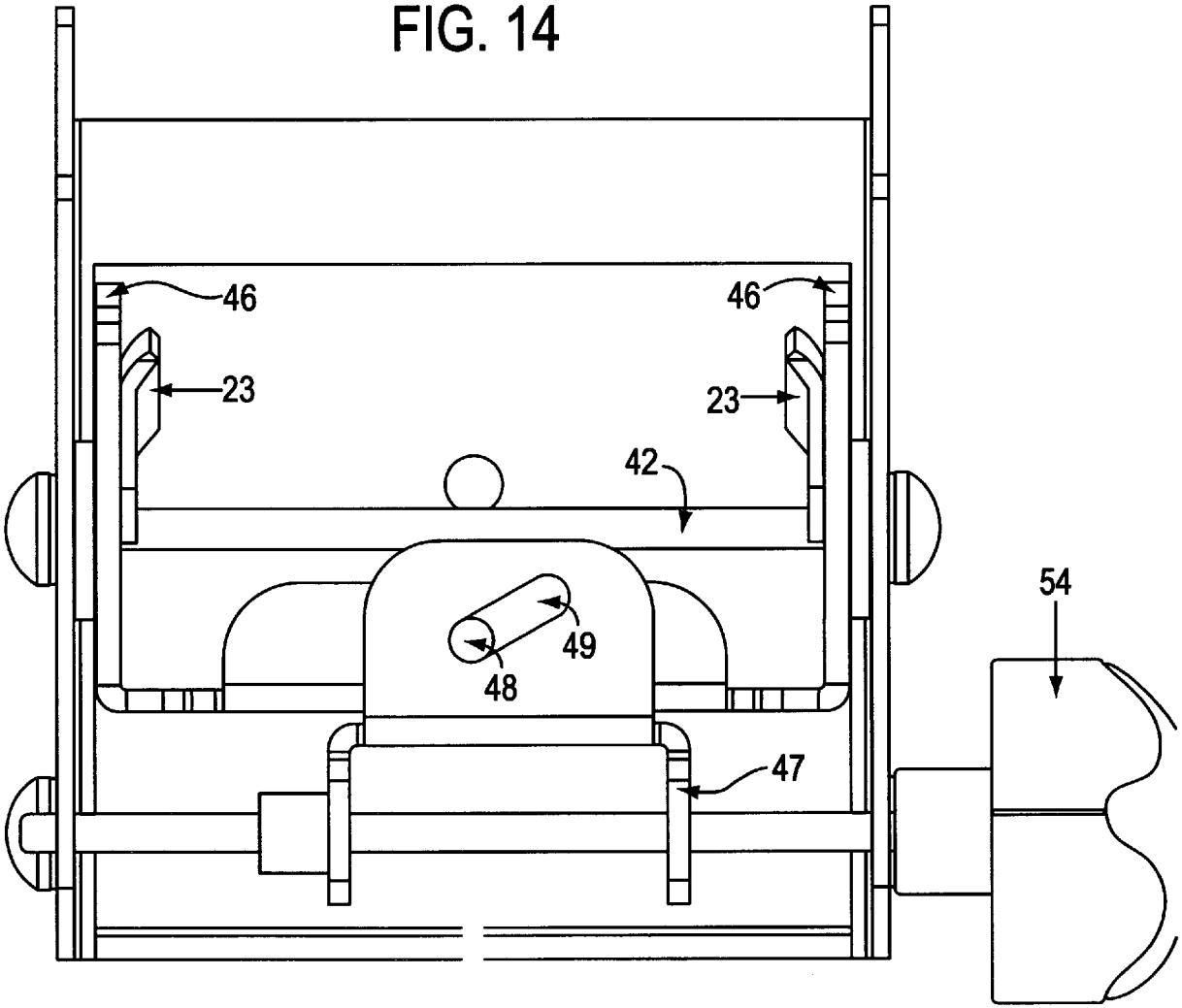
FIG. 14 is a bottom view of the embodiment shown in FIG. 13.
Figure 16:
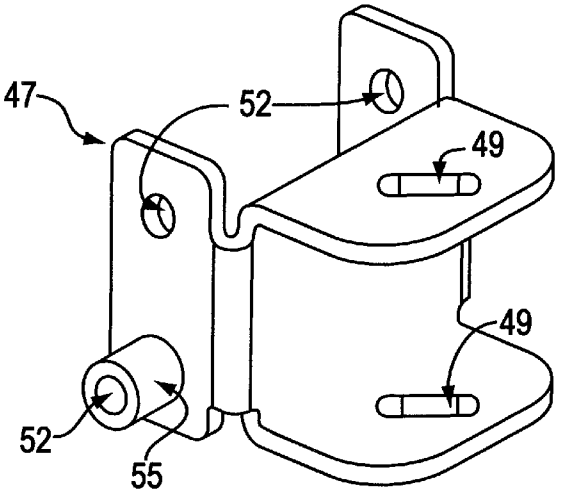
FIG. 16 is a top elevational view of a different element of the mechanism used to allow the stopping means to move as shown in FIG. 13.

For example, looking at FIG. 14, if setting bracket 47 is pushed to the left, it is easy to see that attachment pin 48 will be forced along opening 49 towards the front of mounting bracket 3, forcing sliding bracket 46 to also move forward, carrying stopping means 23 forward also. By varying the angle of opening 49 it is possible to control how much sideways movement of setting bracket 47 will force forward movement of sliding bracket 46.

In the embodiment shown in FIGS. 13 and 14, the lateral position of setting bracket 47 (and hence sliding bracket 46 and stopping means 23) is adjusted by means of knob 54 in combination with threaded attachment rod 50 and threaded fastener 55. Threaded fastener 55 is attached to setting bracket 46 adjacent to one of the holes 52. Threaded attachment rod 50 passes through one hole 52 and threaded fastener 55. One end of threaded attachment rod 50 is attached to knob 54 (which is positioned on the outside of mounting bracket 3), while the other is rotatably fixed to the opposite side of mounting bracket 3. When knob 54 is turned by the user, it turns threaded attachment rod 50 and causes it to interact with threaded fastener 55. Because threaded attachment rod 50 is rotatably fixed, threaded fastener 55 is forced to "migrate" up and down threaded attachment rod 50, causing setting bracket 46 to move laterally, and the rest of the mechanism to move forwards and backwards as described above.

Figure 19:
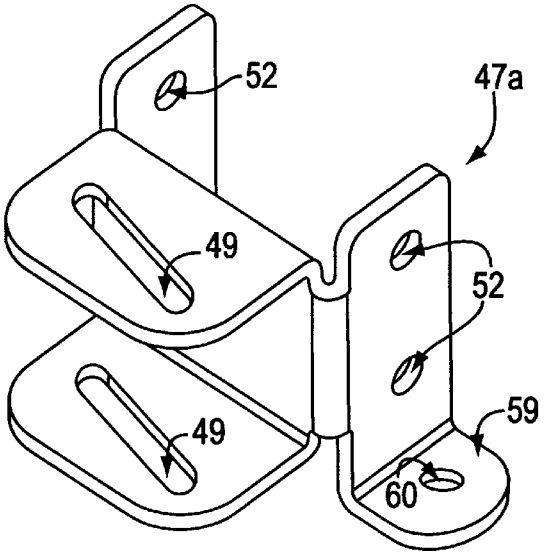
FIG. 19 is a top elevational view of an element of the mechanism used to allow the stopping means to move as shown in FIG. 17.
Figure 17:
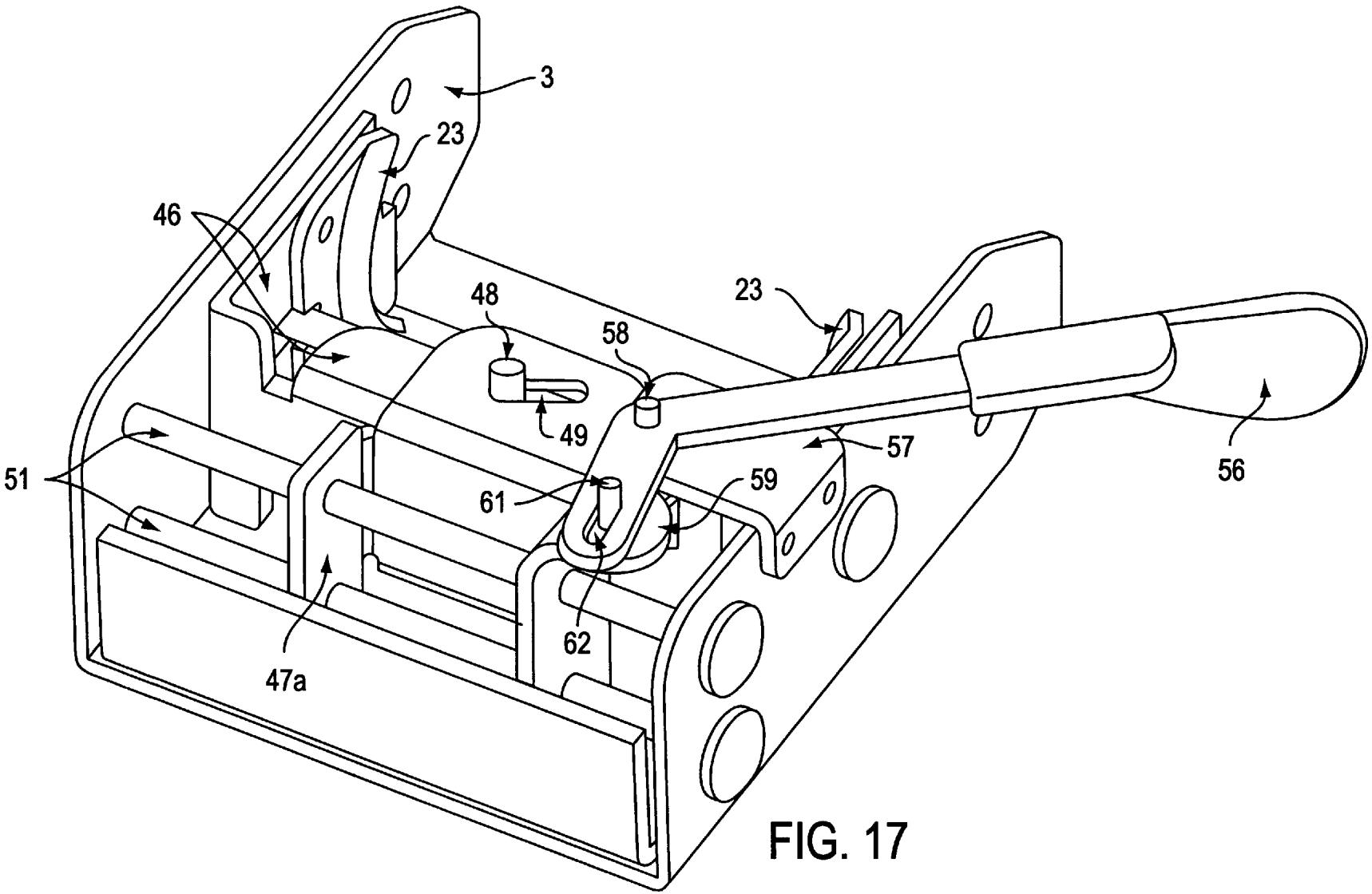
FIG. 17 is a bottom elevational view of a different movable stopping means.
Figure 18:
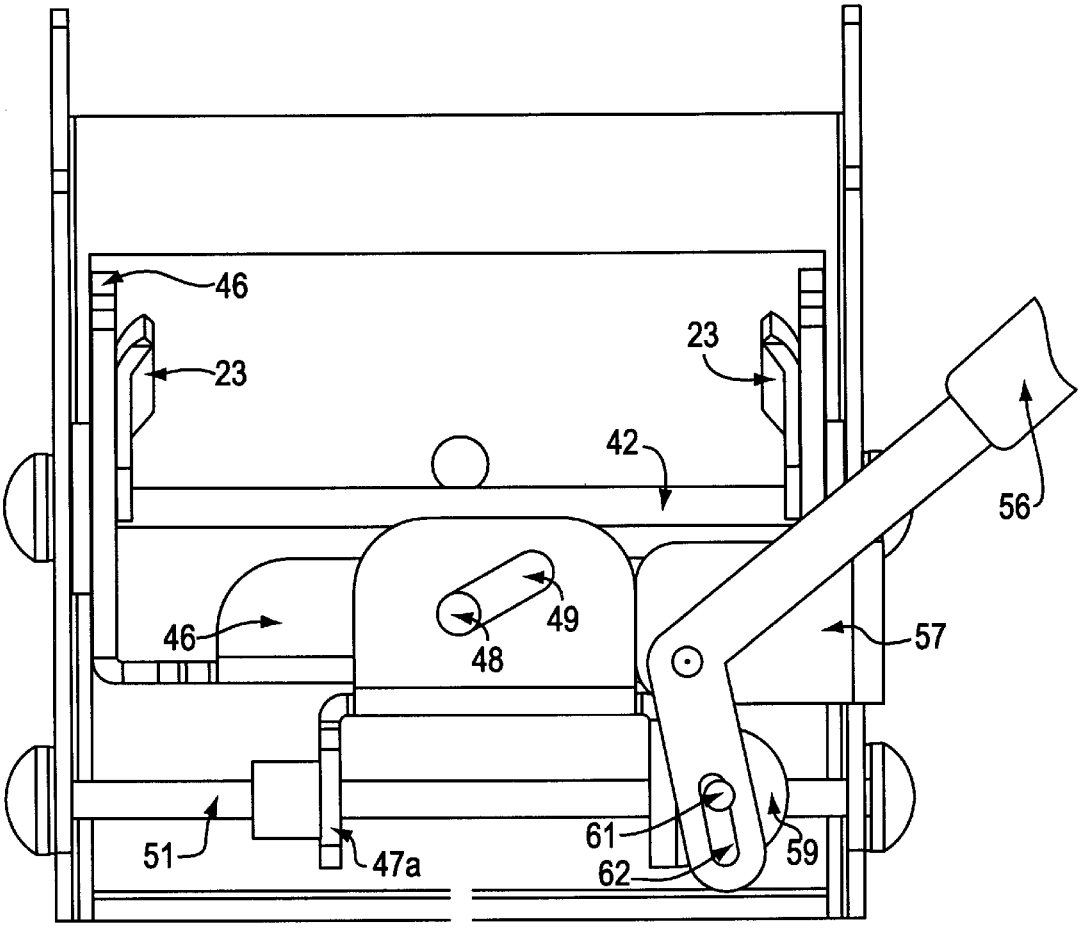
FIG. 18 is a bottom view of the embodiment shown in FIG. 17.

A related mechanism for adjusting the position of the stopping means 23 is shown in FIGS. 17–19. In this embodiment, the position of the stopping means 23 is adjusted by means of sliding bracket 46 in combination with setting bracket **47*a*. However, the lateral position of setting bracket 47*a* is not adjusted by means of threaded screw mechanism as described above, but rather by means of adjustment lever 56. Setting bracket 47*a* differs from setting bracket 47 in that it includes a laterally protruding wing 59, which has within it a hole 60. Position bracket 57 is fixedly attached to mounting bracket 3. Adjustment lever 56 is pivotally attached to position bracket 57 by pin 58. Adjustment lever 56 is attached to setting bracket 47***a* by means of pin 61 which passes through hole 60 in setting bracket 47*a* and through slot 62 in adjustment lever 56.

When the handle 63 of adjustment lever 56 is moved by the user, adjustment lever 56 pivots around pin 58. This in turn forces movement of slot 62 relative to mounting bracket 3. Because of the attachment of setting bracket 47*a* to adjustment lever 56 by means of pin 61 through slot 62, movement of slot 62 forces lateral movement of setting bracket 47*a* along attachment rods 51. As discussed above, this in turn provides forward and backwards movement of stopping means 23.

Depending upon the exact mechanism used to adjust the stopping means, such adjustment can be easier or more difficult for the user. For example, if the stopping means can only be adjusted using a screwdriver (instead of by the mechanisms described above) it will less convenient to adjust. This arrangement may be desirable for some applications, where it is sought to minimize the number of adjustments which can be made by the immediate user.

The primary purpose behind adjusting the stopping means is to adjust the angle of keyboard shelf 4 relative to the ground. The farther forward stopping means 23 is positioned, the greater the elevation of the front of shelf bracket 4, and vice-versa. An alternative means for adjusting the horizontal orientation of shelf bracket 4 which is particularly useful when stopping means 23 is not adjustable is by means of conventional locking knob 31, as shown in FIG. 1. Bolt 14 is screwed into locking knob 31. When locking knob 31 is turned, bolt 14 is prevented from also turning by the interaction of its square end with lateral opening 16. The threaded connection between locking knob 31 and bolt 14 forces locking knob 31 to move in towards spacer 41, forcing side arm 5 and lower arm 17 into closer contact with spacer 41. This eventually tightens the system to the point where neither rotation or lateral movement of lower arm 17 or side arm 5 about bolt 14 is possible. To facilitate the "squeezing" of lower arm 17, its rearward sections around and adjacent to openings 20 do not have a bottom section connecting them, unlike at the its forward sections around and adjacent to fourth pivot rod 18.

When locking knob 31 is used, the angle of shelf bracket 4 can be adjusted by tilting the front of shelf bracket 4 up, pulling side arm 5 away from stopping means 23 and locking shelf bracket 4 into this position by tightening locking knob 31. By "locking" side arm 5 at a position where it is pulled away from stopping means 23, the angle of shelf bracket 4 can be altered from what would permitted by the use of stopping means 23. The use of locking knob 31 is preferred when only one side arm 5 and one stopping means 23 are used, and when stopping means 23 cannot be moved. Locking knob 31 can also be used in conjunction with a movable stopping means.

Other similar, known friction-based systems, such as stopping means with handles, can be used in place of locking knob 31.

The height at which shelf bracket 4 is maintained during use or storage relative to desktop 36 is controlled by the interaction of side arms 5 and stopping means 23. Each side arm 5 contacts the first side 24 of stopping means 23, stopping the rearward motion of the side arms 5 and keeping the shelf bracket 4 at a constant angle relative to the ground. By tilting the front of shelf bracket 4 up, each side arm 5 is pulled away from its respective stopping means 23, permitting vertical movement of the auxiliary shelf mechanism 1. When the front of shelf bracket 4 is released, each side arm 5 once again contacts its respective stopping means 23. The curved end 21 of each side arm 5 does not slide relative to its respective stopping means 23 because of friction. Placing additional weight on shelf bracket 4 simply causes the curved ends 21 of the side arms 5 to "dig" into each stopping means 23 even more, further inhibiting vertical movement of auxiliary shelf mechanism 1.

Figure 10:
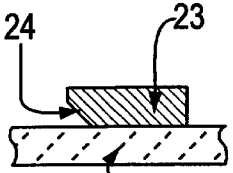
FIG. 10 is a top view of a portion of an embodiment of the invention, showing a stopping means with a chamfer in combination with a section of the mounting bracket.
Figure 11:
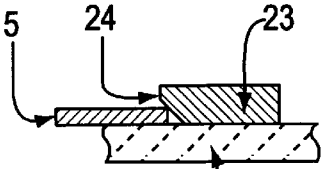
FIG. 11 shows the same view as shown in FIG. 10, with the stopping means with a chamfer and a portion of the mounting bracket, with the additional showing of the side arm.

This friction based impediment to movement is enhanced by the use of a preferred configuration of stopping means 23. In this preferred embodiment, first face 24 of stopping means 23 is concave and has a 45° chamfer directed towards the outside of the mechanism (i.e. towards the mounting bracket). (One of skill in the art will readily appreciate that the angle of the chamfer can be varied.) This is shown in more detail in FIG. 10. This chamfer "funnels" the side arm into a corner created by the stopping means and the mounting bracket, as shown in FIG. 11. The increased amount of friction resulting from this arrangement results in greater vertical stability for auxiliary shelf mechanism 1.

Figure 12:
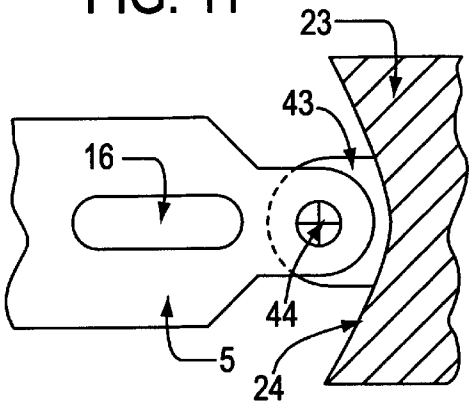
FIG. 12 shows a side view of an alternate embodiment of the side arm in combination with the stopping means.

An alternative means for improving the vertical stability of auxiliary shelf mechanism 1 involves providing curved ends 21 of side arms 5 with a series of "teeth" which can cooperate with a complementary series of"teeth" on the first side 24 of stopping means 23. The interaction of the teeth on curved end 21 and the first side 24 can prevent vertical movement of auxiliary shelf mechanism 1. A further alternative, shown in FIG. 12 is to attach a pivoted side-arm cam 45 to curved end 21 of side arm 5 by means of pin 44. The curvature of pivoted side-arm cam 45 complements that of first side 24, thus maximizing the contact area between the surfaces and the amount of friction between them, resulting in greater vertical stability for auxiliary shelf mechanism 1.

Any of the foregoing methods for vertically stabilizing auxiliary shelf mechanism 1 may be used in combination with any of the others (c.1. teeth may be placed on pivoted side-arm cam 45, and curved face 24 of stopping means 23).

Regardless of what system (if any), is used to stabilize the vertical positioning of auxiliary shelf mechanism 1, the use of the stopping means/side arm mechanism permits the user to adjust the height of the keyboard in a facile, intuitive manner, without the need to reach awkwardly around the keyboard and fumble for levers or knobs. Moreover, this system is also mechanically quite simple, does not require the complex locking mechanisms of prior art devices, and presents a significant improvement over those devices.

Figure 6:
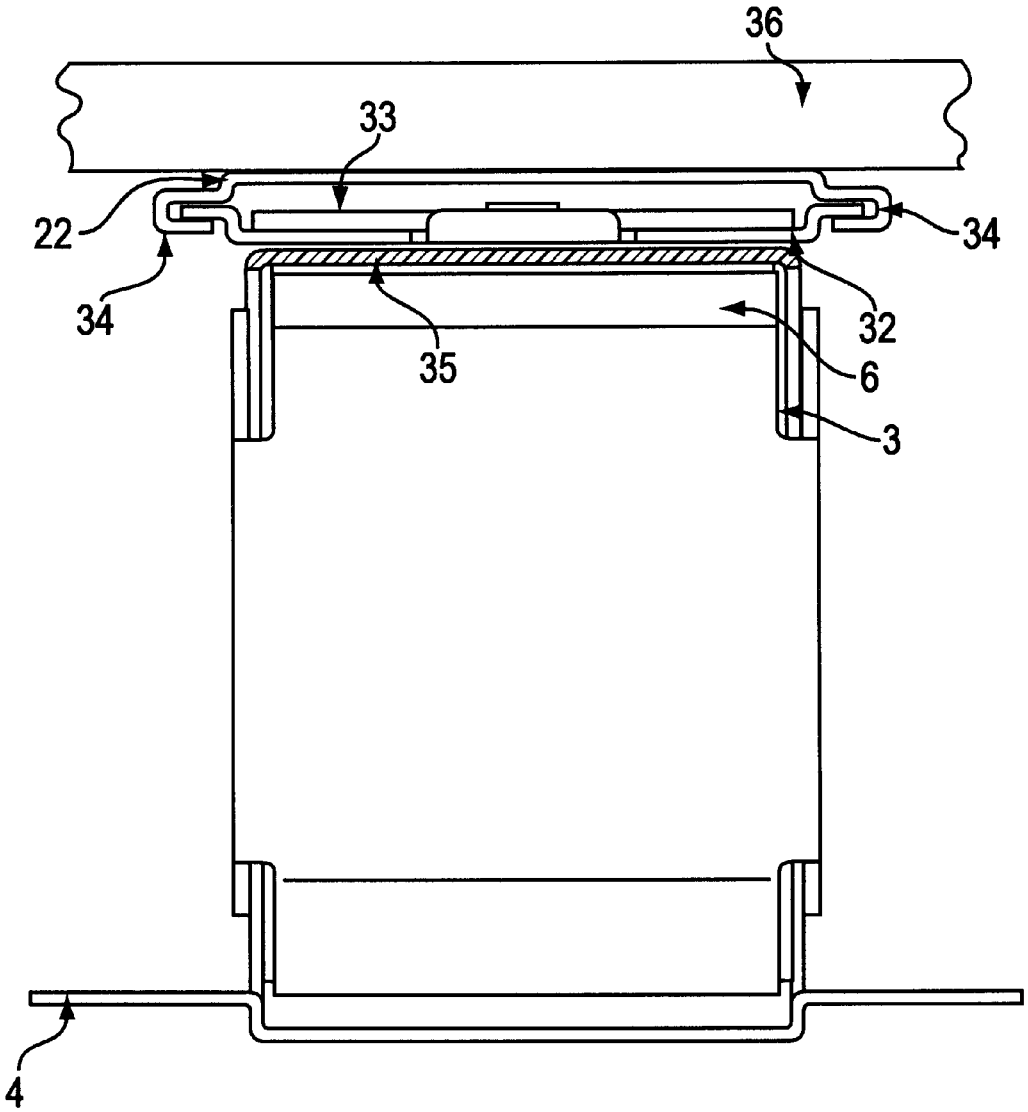
FIG. 6 is a front elevational view of the auxiliary shelf mechanism, showing the means by which the mechanism can be made to rotate as shown in FIG. 4.

FIG. 6 shows the means by which lateral movement of auxiliary shelf mechanism 1 is achieved. Mounting track 22 is attached to the underside of desktop 36, normally so that it is perpendicular to the front edge of desktop 36. The outside edges of mounting track 22 are configured so as to form a pair of inwardly facing, C-shaped brackets 34. Swivel bracket 32 is shaped so that it will fit into the C-shaped brackets 34. Swivel bracket 32 (and the rest of auxiliary shelf mechanism 1) can be moved by simply pushing the mechanism back and forth along the track. Unwanted lateral movement of auxiliary shelf mechanism 1 is controlled by friction between swivel bracket 32 and C-shaped brackets 34. Moreover, when weight is placed on shelf bracket 4 (for example when a keyboard and/or a pair of hands is resting on it), this will have a tendency to cause swivel bracket 32 to tilt forward, causing the rear of swivel bracket 32 to contact the top of C-shaped brackets 34, increasing the friction-based resistance of auxiliary shelf mechanism 1 to lateral movement. If desired, an additional locking mechanism may be provided to prevent lateral movement, but such a mechanism is generally unnecessary and makes adjustment of the position of auxiliary shelf mechanism 1 more cumbersome. Mechanical stops (not shown) may be employed at either end of C-shaped brackets 34 to ensure that auxiliary shelf mechanism 1 does not slide off mounting track 22 and fall to the floor.

As an alternative to C-shaped brackets 34, downward facing T-shaped tracks may be used in conjunction with compatible structures on the mounting bracket, such as is set forth in U.S. Pat. No. 4,644,875. Other known means for mounting auxiliary shelf mechanism 1 to the underside of the desk can also be used.

Swivel bracket 32 is attached to swivel bracket assembly 33, mounting bracket 3, and mounting bracket support 6 by means of a rivet (not shown). A large washer 35 is fitted between swivel bracket 32 and mounting bracket 3. The washer may be made of any number of hard and slippery materials, including metals, but is preferably made of a hard plastic such as polyethylene, and most preferably made of nylon. Mounting bracket support 6 is attached to the inside of mounting bracket 3. Generally, that attachment will be fixed (for example by spot welding or flat rivets). Therefore, when lateral force is exerted against auxiliary shelf mechanism 1, mounting bracket 3 will tend to rotate around the rivet relative to swivel bracket 32, which is prevented from rotating by the C-shaped brackets 34 of mounting track 22. Thus, auxiliary shelf mechanism 1 can be rotated relative to the mounting track 22 and the desk top, as shown in FIG. 4. The rotational mechanism described herein is known in the art, and other known mechanisms may also be used.

The materials used in the construction of auxiliary shelf mechanism 1 can be varied, but will be a stiff material for most components, preferably steel or another metal or metal alloy. In a preferred embodiment, curved ends 21 of side arms 5 and first sides 24 of stopping means 23 will have surfaces which are rough enough so as to limit their ability to slide past one another, locking the system in place as described above and enhancing its vertical stability.

Another advantage of the present invention is that the shelf bracket is the part of the auxiliary shelf mechanism 1 which is closest to the ground. Nothing projects below shelf bracket 4 as in other prior art mechanisms, such as is shown in U.S. Pat. Nos. 5,257,767 and 4,616,798, described above. Thus, when the keyboard is pushed beneath the desk, the amount of leg room is maximized. This is achieved by attaching the various arms connecting mounting bracket 3 to shelf bracket 4 to the top and side of shelf bracket 4.

The present inventors have found that by equipping the shelf bracket with an upwardly extending piece to permit attachment of link means, the vertical profile of the overall mechanism can be shortened, increasing the leg room available to the user when the keyboard is positioned beneath the desk. Thus, another aspect of the present invention is the attachment of an auxiliary shelf (or keyboard shelf) to a desk top, so that the auxiliary shelf can move both horizontally and vertically relative to the desk top, the attachment being made so that nothing extends below the bottom of the auxiliary shelf. This arrangement maximizes the amount of leg room beneath the auxiliary shelf. The attachment between the auxiliary shelf and the desk can be made by either a parallelogram linkage, or by a non-parallelogram linkage, or by a linkage of the type described in detail in this application (i.e. upper arm-side arm-stopping means).

One means by which this type of attachment may be accomplished is by using an auxiliary shelf with a vertically oriented piece attached to its rear side. The linkage can be attached to this vertically oriented piece, precluding the need for anything to project beneath the auxiliary shelf. For example, shelf bracket 4 is shaped in such a way that a more conventional parallelogram linkage or non-parallelogram linkage could be used, instead of the upper arm-side arm-stopping means system shown specifically in the drawings. Other attachment means may also be used, as will be readily apparent to those of skill in this area.

We claim:

1. An improved auxiliary shelf mechanism for vertically and horizontally positioning an auxiliary shelf, including a means for attaching the auxiliary shelf to a desk so that the auxiliary shelf may be moved horizontally relative to the desk, wherein the improvement comprises:

an articulating arm mechanism comprising:

(a) a mounting bracket, the mounting bracket having a front end and a back end;

(b) an upper arm having a rear end and a front end, the upper arm being pivotally connected to the mounting bracket at a first pivot point, the rear of the upper arm being defined as the end of the upper arm closest to the mounting bracket; the front end being defined as the end opposite the rear end;

(c) a shelf bracket pivotally connected to the upper arm at a second pivot point;

(d) a side arm having a front end and a rear end, the side arm being pivotally connected to the shelf bracket at a third pivot point; the side arm being further attached to the mounting bracket at a fourth pivot point; the side arm having within it a first opening such that the side arm can be pivoted relative to the mounting bracket about the fourth pivot point and can be reciprocatingly moved relative to the fourth pivot point; the front of the side arm being defined as the end closest to the third pivot point, and the rear of the side arm being defined as the end opposite from the front;

(e) a stopping means, the stopping means having a first side facing towards the rear of the side arm, such that when the side arm moves laterally relative to the fourth pivot point, the rear of the side arm can contact the first side of the stopping means;

wherein the stopping means is movable between a first position and a second position, the first position being closer to the front end of the mounting bracket than the second position, and the second position being closer to the back end of the mounting bracket than the first position.

2. The auxiliary shelf mechanism of claim 1, wherein the position of the stopping means is adjusted by means of a lever mechanism, the lever mechanism comprising an adjustment lever, a setting bracket, and a sliding bracket.

3. The auxiliary shelf mechanism of claim 1, wherein the position of the stopping means can be fixed at either the first position, or the second position, or at any position between the first and second positions.

4. The auxiliary shelf mechanism of claim 3, wherein the position of the stopping means is adjusted by means of a threaded screw mechanism.

5. An improved auxiliary shelf mechanism for vertically and horizontally positioning an auxiliary shelf, including a means for attaching the auxiliary shelf to a desk so that the auxiliary shelf may be movably positioned relative to the desk, wherein the improvement comprises:

an articulating arm mechanism comprising:

(a) a mounting bracket, the mounting bracket having a front end and a back end;

(b) an upper arm having a rear end and a front end, the upper arm being pivotally connected to the mounting bracket at a first pivot point, the rear of the upper arm being defined as the end of the upper arm closest to the mounting bracket, the front end being defined as the end opposite the rear end;

(c) a shelf bracket pivotally connected to the upper arm at a second pivot point;

(d) a side arm having a front end and a rear end, the side arm being pivotally connected to the shelf bracket at a third pivot point; the side arm being further attached to the mounting bracket at a fourth pivot point; the side arm having within it a first opening such that the side arm can be pivoted relative to the mounting bracket about the fourth pivot point and can be reciprocatingly moved relative to the fourth pivot point; the front of the side arm being defined as the end closest to the third pivot point, and the rear of the side arm being defined as the end opposite from the front;

(e) a stopping means, the stopping means having a first side facing towards the rear of the side arm, such that when the side arm moves laterally relative to the fourth pivot point, the rear of the side arm can contact the first side of the stopping means;

wherein the side arm and the upper arm are not substantially parallel to each other, and further wherein the first and fourth pivot points are closer together than the second and third pivot points.

6. An improved auxiliary shelf mechanism for vertically and horizontally positioning an auxiliary shelf, including a means for attaching the auxiliary shelf to a desk so that the auxiliary shelf may be movably positioned relative to the desk, wherein the improvement comprises:

an articulating arm mechanism comprising:

(a) a mounting bracket, the mounting bracket having a front end and a back end;

(b) an upper arm having a rear end and a front end, the upper arm being pivotally connected to the mounting bracket at a first pivot point, the rear of the upper arm being defined as the end of the upper arm closest to the mounting bracket, the front end being defined as the end opposite the rear end;

(c) a shelf bracket pivotally connected to the upper arm at a second pivot point;

(d) a side arm having a front end and a rear end, the side arm being pivotally connected to the shelf bracket at a third pivot point; the side arm being further attached to the mounting bracket at a fourth pivot point; the side arm having within it a first opening such that the side arm can be pivoted relative to the mounting bracket about the fourth pivot point and can be reciprocatingly moved relative to the fourth pivot point; the front of the side arm being defined as the end closest to the third pivot point, and the rear of the side arm being defined as the end opposite from the front;

(e) a stopping means, the stopping means having a first side facing towards the rear of the side arm, such that when the side arm moves laterally relative to the fourth pivot point, the rear of the side arm can contact the first side of the stopping means;

wherein the side arm and the upper arm are not substantially parallel to each other, and further wherein the first and fourth pivot points are closer together than the second and third pivot points.

7. An improved auxiliary shelf mechanism for vertically and horizontally positioning an auxiliary shelf, including a means for attaching the auxiliary shelf to a desk so that the auxiliary shelf may be movably positioned relative to the desk, wherein the improvement comprises:

an articulating arm mechanism comprising:

(a) a mounting bracket, the mounting bracket having a front end and a back end;

(b) an upper arm having a rear end and a front end, the upper arm being pivotally connected to the mounting bracket at a first pivot point, the rear of the upper arm being defined as the end of the upper arm closest to the mounting bracket, the front end being defined as the end opposite the rear end;

(c) a shelf bracket pivotally connected to the upper arm at a second pivot point;

(d) a side arm having a front end and a rear end, the side arm being pivotally connected to the shelf bracket at a third pivot point; the side arm being further attached to the mounting bracket at a fourth pivot point; the side arm having within it a first opening such that the side arm can be pivoted relative to the mounting bracket about the fourth pivot point and can be reciprocatingly moved relative to the fourth pivot point; the front of the side arm being defined as the end closest to the third pivot point, and the rear of the side arm being defined as the end opposite from the front;

(e) a stopping means, the stopping means having a first side facing towards the rear of the side arm, such that when the side arm moves laterally relative to the fourth pivot point, the rear of the side arm can contact the first side of the stopping means;

wherein the side arm and the upper arm are not substantially parallel to each other, and wherein the articulating arm mechanism further comprises a lower arm, the lower arm being pivotally attached to the upper arm at a fifth pivot point, the fifth pivot point being disposed between the first and second pivot points, the lower arm being further attached to the mounting bracket at the fourth pivot point, the lower arm further having within it a second opening, such that the lower arm can pivot about the fourth pivot point and can be reciprocatingly moved relative to the fourth pivot point.

8. An articulating arm mechanism for connecting a shelf to a desk comprising:

(a) a mounting bracket, the mounting bracket having a front end and a back end;

(b) an upper arm having a rear end and a front end, the upper arm being pivotally connected to the mounting bracket at a first pivot point, the rear of the upper arm being defined as the end of the upper arm closest to the mounting bracket, the front end being defined as the end opposite the rear end;

(c) a shelf bracket pivotally connected to the upper arm at a second pivot point;

(d) a side arm having a front end and a rear end, the side arm being pivotally connected to the shelf bracket at a third pivot point; the side arm being further attached to the mounting bracket at a fourth pivot point; the side arm having within it a first opening such that the side arm can be pivoted relative to the mounting bracket about the fourth pivot point and can be reciprocatingly moved relative to the fourth pivot point; the front of the side arm being defined as the end closest to the third pivot point, and the rear of the side arm being defined as the end opposite from the front;

(e) a stopping means, the stopping means having a first side facing towards the rear of the side arm, such that when the side arm moves laterally relative to the fourth pivot point, the rear of the side arm can contact the first side of the stopping means;

wherein the side arm and the upper arm are not substantially parallel to each other; and further wherein the first and fourth pivot points are closer together than the second and third pivot points.

9. An articulating arm mechanism for connecting a shelf to a desk comprising:

(a) a mounting bracket, the mounting bracket having a front end and a back end;

(b) an upper arm having a rear end and a front end, the upper arm being pivotally connected to the mounting bracket at a first pivot point, the rear of the upper arm being defined as the end of the upper arm closest to the mounting bracket, the front end being defined as the end opposite the rear end;

(c) a shelf bracket pivotally connected to the upper arm at a second pivot point;

(d) a side arm having a front end and a rear end, the side arm being pivotally connected to the shelf bracket at a third pivot point; the side arm being further attached to the mounting bracket at a fourth pivot point; the side arm having within it a first opening such that the side arm can be pivoted relative to the mounting bracket about the fourth pivot point and can be reciprocatingly moved relative to the fourth pivot point; the front of the side arm being defined as the end closest to the third pivot point, and the rear of the side arm being defined as the end opposite from the front;

(e) a stopping means, the stopping means having a first side facing towards the rear of the side arm, such that when the side arm moves laterally relative to the fourth pivot point, the rear of the side arm can contact the first side of the stopping means;

wherein the side arm and the upper arm are not substantially parallel to each other; and further wherein the second and third pivot points are closer together than the first and fourth pivot points.

10. An articulating arm mechanism for connecting a shelf to a desk comprising:

(a) a mounting bracket, the mounting bracket having a front end and a back end;

(b) an upper arm having a rear end and a front end, the upper arm being pivotally connected to the mounting bracket at a first pivot point, the rear of the upper arm being defined as the end of the upper arm closest to the mounting bracket, the front end being defined as the end opposite the rear end;

(c) a shelf bracket pivotally connected to the upper arm at a second pivot point;

(d) a side arm having a front end and a rear end, the side arm being pivotally connected to the shelf bracket at a third pivot point; the side arm being further attached to the mounting bracket at a fourth pivot point; the side arm having within it a first opening such that the side arm can be pivoted relative to the mounting bracket about the fourth pivot point and can be reciprocatingly moved relative to the fourth pivot point; the front of the side arm being defined as the end closest to the third pivot point, and the rear of the side arm being defined as the end opposite from the front;

(e) a stopping means, the stopping means having a first side facing towards the rear of the side arm, such that when the side arm moves laterally relative to the fourth pivot point, the rear of the side arm can contact the first side of the stopping means;

wherein the side arm and the upper arm are not substantially parallel to each other, and wherein the articulating arm mechanism further comprises a lower arm, the lower arm being pivotally attached to the upper arm at a fifth pivot point, the fifth pivot point being disposed between the first and second pivot points, the lower arm being further attached to the mounting bracket at the fourth pivot point, the lower arm further having within it a second opening, such that the lower arm can pivot about the fourth pivot point and can be reciprocatingly moved relative to the fourth pivot point.

11. An articulating arm mechanism for connecting a shelf to a desk comprising:

(a) a mounting bracket, the mounting bracket having a front end and a back end;

(b) an upper arm having a rear end and a front end, the upper arm being pivotally connected to the mounting bracket at a first pivot point, the rear of the upper arm being defined as the end of the upper arm closest to the mounting bracket, the front end being defined as the end opposite the rear end;

(c) a shelf bracket pivotally connected to the upper arm at a second pivot point;

(d) a side arm having a front end and a rear end, the side arm being pivotally connected to the shelf bracket at a third pivot point; the side arm being further attached to the mounting bracket at a fourth pivot point; the side arm having within it a first opening such that the side arm can be pivoted relative to the mounting bracket about the fourth pivot point and can be reciprocatingly moved relative to the fourth pivot point; the front of the side arm being defined as the end closest to the third pivot point, and the rear of the side arm being defined as the end opposite from the front;

(e) a stopping means, the stopping means having a first side facing towards the rear of the side arm, such that when the side arm moves laterally relative to the fourth pivot point, the rear of the side arm can contact the first side of the stopping means;

wherein the stopping means is movable between a first position and a second position, the first position being closer to the front end of the mounting bracket than the back position, and the second position being closer to the back end of the mounting bracket than the first position.

12. The articulating arm mechanism of claim 11, wherein the position of the stopping means can be fixed at either the first position, or the second position, or at any position between the first and second positions.

13. The articulating arm mechanism of claim 12, wherein the position of the stopping means is adjusted by means of a threaded screw mechanism.

14. The articulating arm mechanism of claim 1, wherein the position of the stopping means is adjusted by means of a lever mechanism, the lever mechanism comprising an adjustment lever, a setting bracket, and a sliding bracket.

* * * * *